United States Patent [19]

Spurrell

[11] 4,235,174

[45] Nov. 25, 1980

[54] HEAT RECOVERY FROM WET WOOD WASTE

[75] Inventor: Robert M. Spurrell, Auburn, Wash.

[73] Assignee: Weyerhaeuser Company, Tocoma, Wash.

[21] Appl. No.: 963,624

[22] Filed: Nov. 24, 1978

[51] Int. Cl.[3] ..... F23G 5/00

[52] U.S. Cl. ..... 110/346; 110/216; 110/220; 110/234; 110/245

[58] Field of Search ..... 110/234, 235, 243, 244, 110/226, 346, 102, 245, 220, 341, 216

[56] References Cited

U.S. PATENT DOCUMENTS

| | | | |
|---|---|---|---|
| 3,831,535 | 8/1974 | Baardson | 110/220 X |
| 3,922,975 | 12/1975 | Reese | 110/245 X |
| 3,951,081 | 4/1976 | Martin et al. | 110/220 |
| 4,060,041 | 11/1977 | Sowards | 110/245 |
| 4,075,953 | 2/1978 | Sowards | 110/245 |

*Primary Examiner*—Edward G. Favors

[57] ABSTRACT

Overall heat recovery from wet wood waste, particularly sawmill-generated hog fuel, is improved by a process for predrying the fuel. A wet oversize fraction of the fuel is combusted in a fluid bed reactor providing heat for drying the remaining smaller sized fraction of the waste pile to about 10–30% moisture by weight. The gaseous products of the fluid bed burning are contacted with the fuel fraction in, preferably, a rotary dryer. The dried fuel is then screened into coarse and fine fractions. The coarse fraction is fed onto a grate of a wood waste boiler. The fines fraction is injected into the boiler combustion in an air suspension. The amount of fuel fed to the fluid bed reactor is 10–25% of the total fuel flow, depending upon the moisture content of the fuel. The gases fed to the rotary dryer are less than about 1,200° F., to minimize "blue haze," by combining with minimum outside air.

5 Claims, 1 Drawing Figure

HEAT RECOVERY FROM WET WOOD WASTE

BACKGROUND OF THE INVENTION

1. Field of the Invention

The field of this invention is heat recovery from wet wood waste. More particularly, the fuel of interest is hog fuel generated by sawmills and similar wood processing facilities.

2. Description of the Prior Art

In the past few years it has become increasingly evident to processing operators utilizing wood as a raw material, especially in sawmills integrated with pulp or composite products operation, that profitability requires the use of as much of the incoming raw wood material as possible. Wood waste, unsuitable for composite products, is now commonly burned for its heating value. Since these wastes, as burned, are typically low in heating value, many burning systems require supplemental oil or gas fuel in order to facilitate smooth operation. Recent escalation in the cost of oil or other clean energy resources has focused attention upon the efficiency of these heat recovery processes. This is particularly true since many of the wood burning systems were designed in the 1960s, primarily as an alternative to land-fill disposal, before the value of energy dramatically increased.

Wood waste from sawmilling and related raw wood handling operations has two characteristics that make efficient recovery of the heating values difficult. First of all, typical sawmill waste, commonly called in aggregation "hog fuel," has a very irregular particle size range. The wastes are generated from every wood handling and processing operation. These wastes range from sander dust of 100 mm diameter average particle size to bark and log yard debris that may exceed dimensions of 1' in diameter by 4' in length.

The second difficult characteristic is that hog fuel, as fired, may be very wet, even exceeding the 68% moisture limit of self-sustaining combustion on occasions. Each sawmill source of waste has its own characteristic moisture content. However, since the major source of waste is bark which is often removed hydraulically, the fuel flow to the boiler is generally wet. Most wastes are also stored out in the weather so that the normally drier sawdusts and shavings soak up rain water during wet periods of the year.

A common practice in the past has been to burn wet hog fuels using supplemental oil to sustain combustion and achieve reasonable steaming production rates. This approach, of course, is less attractive in view of the high cost of oil.

The more recent approach has been to reduce moisture content of the hog fuel prior to burning for heat recovery into a combination oil-wood waste boiler. Studies show that reducing the moisture content of the fuel burned improves steam production and reduces boiler stack emissions. The dry fuel requires less excess air and thus boiler heat losses are reduced, improving overall thermal efficiency. The resulting higher combustion zone temperature apparently ensures incineration of particulate material before it floats out the stack.

R. C. Johnson in "Some Aspects of Wood Waste Preparation for Use as a Fuel," TAPPI Vol. 58, No. 7 (July 1975) describes almost doubling steam production rates for a wood waste recovery system by reducing fuel moisture content from 63% to 28% by weight. The Johnson article is incorporated by reference herein as showing the state-of-the-art.

Johnson describes a process for predrying hog fuel, utilizing a rotary dryer. The wet wood waste is screened and any oversize reduced to 100% minus 4" in diameter. The wood waste is then introduced into a rotary dryer where combustion gases dry the waste to about 30% moisture. After drying, a fines portion is separated from the dried fuel. The fines are then fed to a burner system which provides heat for the rotary dryer. The balance of the dry fuel, that is the coarse fraction, is fed onto the grate of a conventional wood waste boiler for heat recovery through steam production.

While improving the overall system's thermal efficiency and heat release rates, the burning of fines to dry the hog fuel is not without difficulties. The fines burners must be relatively precisely designed and operated to avoid high maintenance down time. Fuel for the dryer fines furnace, of course, must be predried and sized, which relatively stringent requirements can lead to difficulties or require supplemental high-cost fuels, particularly upon start-up.

Fluidized bed reactors for burning combustibles that vary widely in particle size and moisture content are described in the literature. Reese, in U.S. Pat. No. 3,882,798, assigned to Combustion Power Company, Inc., shows a system for burning municipal refuse by injecting the light fraction of the waste into a fluidized bed of inert or chemically reactive fine granular solids. Sowards, in U.S. Pat. No. 4,060,041 teaches burning wet wood waste in a fluidized bed of olivine.

SUMMARY OF THE INVENTION

An object of this invention is to precondition wet wood waste prior to burning in a wood waste heat recovery boiler to improve overall heat recovery from the waste resource. "Preconditioning" means drying a portion of the waste prior to feeding into a main heat recovery boiler. Further, the dried fuel is sized and burned in the boiler using burners that are most suited for the particular size range fed to it. Overall steaming production capacity may be increased for recovery processes converted to the process of this invention.

It is an object of the invention to provide a process for drying wet hog fuel using an oversize fraction of the waste without need to precondition this drying fuel portion. It is an object to avoid the maintenance and start-up difficulties encountered in drying hog fuel in a rotary dryer using dried fines as the heat source. The system proposed uses the coarsest, wettest portion of the hog fuel pile to provide drying heat for the balance of the waste which is then burned for heat recovery.

In general, the process of this invention, as a means of improving the overall recovery of heating values from wet wood waste, combines a fluidized bed burner, a rotary dryer and a wood waste boiler.

The process of predrying the wood waste is accomplished by: (a) screening the waste into oversize and accepted fractions; (b) feeding the oversize and a portion of the accepted fraction into a fluid bed reactor, wherein such feed is about 10–25% by weight of the total wood waste flow; (c) combusting said wood waste feed in the fluidized reactor; (d) combining with the gaseous products of combustion from the fluid bed combustion such cooler gases or air as is necessary to limit the exit temperature of the gases to less than about 1,200° F.; and (e) contacting the remaining balance of the accepted fraction with the gaseous products of combustion and air wherein the accepted fraction is dried to a moisture content of about 10–30% moisture, by weight. The process continues by combusting the dried fuel in a wood waste heat recovery boiler.

Overall thermal efficiency is further improved by separating the dried accepted fraction into: (a) a coarse fuel fraction having about 30% by weight moisture content and, preferably, a particle size range of ⅛" diameter up to 1½" diameter by 4"; and (b) a fine fuel fraction having about 10–15% by weight moisture content and, preferably, a particle size of less than ⅛" diameter. The coarse fraction is then fed onto a grate that supports the fuel in the combustion zone. The fines fraction, in an air suspension, is injected into the combustion zone.

Combustion of the coarse portion provides heat to meet a relatively fixed base load demand by the energy consuming entity. Combustion of the fines fraction provides heat to meet peak or swing demand levels that occur irregularly. The fines combustion has a quick response to increased demand due to the high-heat release rate characteristic of the finely divided fuel.

Overall heat recovery is further improved by recovering the products of combustion from the main heat recovery boiler and subjecting these gases to the steps of: (a) cleaning the gaseous stream to remove particulate matter therefrom; (b) screening the particulate, resulting in a fly carbon fraction and an inert ash fraction; and (c) injecting said fly carbon fraction into the fluidized bed reactor, wherein the carbon combusts, giving up its heat valve which is then used in drying the accepts stream.

The preferred apparatus for accomplishing the improved heat recovery requires the combination of a fluidized bed reactor whose gaseous products of combustion are injected into a rotary dryer and a wood waste boiler that is provided with a grate and suspension firing burners.

DESCRIPTION OF THE PREFERRED EMBODIMENT

Figure 1:
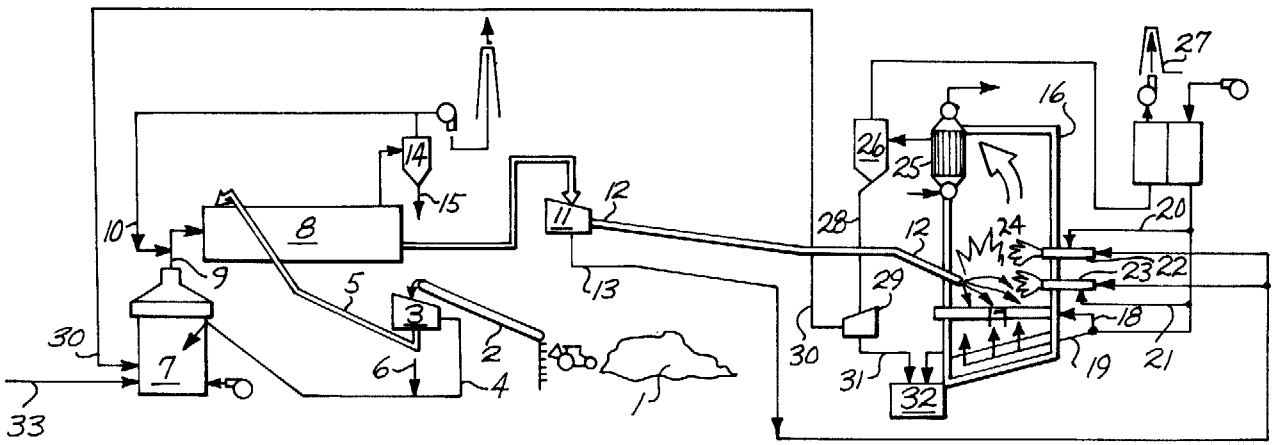
FIG. 1 presents a schematic of the integrated wood waste heat recovery process of the invention.

Referring to FIG. 1, an improved process for recovering heat from reclaimed wood waste is depicted. The wet hog fuel reclaim 1, universally stored outdoors in the weather, is loaded with a bucket loader onto a conveying means 2 which transports the fuel onto screen 3. Screen 3 separates the fuel stream into an oversize fraction 4 and an accepts fraction 5. The oversize fraction 4 is transported by conveying means to fluid bed reactor 7 wherein it is combusted to provide heat to dry the accept fraction 5.

A portion 6 of the accepts fuel may also be injected into the fluid bed 7. The amount of accepts required depends upon the amount of oversize present and the overall moisture content of the hog fuel reclaim. The ratio of fuel burned in the fluid bed to the total fuel flow may range between 0.10–0.25.

A conveying means transports the accepted fraction 5 into rotary dryer 8. Combustion gases 9 also enter the rotary dryer, combined with relatively cool gases or air flow 10. The gas stream 10 is necessary to control temperature in the dryer in the range of 1,000°–1,200° F. The temperature limitation is necessary to control destructive distillation of the wood which produces the "blue haze" associated as an environmental problem with wood drying. A minimum amount of make-up gas or air is utilized since thermal efficiency decreases as excess air increases. In the fluid bed reactor 7, a minimum bed temperature is about 1,000° F. while the maximum temperature in the upper vapor space is limited by the refractory lining of the vessel to about 2,200°.

As the wood waste tumbles through the rotary dryer 8, there is intimate contact with the fluid bed gases and moisture is driven off. The dried fuel at 10–30% by weight moisture content discharges from the dryer 8 onto screen 11. Screen 11 separates the dried fuel into a coarse fraction 12 and a fines fraction 13.

The split achieved, with respect to particle size and moisture content, is determined by the particular characteristics of the wood waste boiler used. As an example, the coarse fraction 12 may range in size from greater than ⅛" diameter up to about 1½" diameter by 4" long and have a moisture content on the order of 30% by weight. The fines fraction may in size be less than ⅛" in diameter and have a moisture content of about 15% by weight.

The gases exiting the dryer are discharged through cleaning equipment 14 which produces a fines residue 15 which is added to the fines stream 13 from screen 11. Both fuel fractions are conveyed to a wood waste boiler 16 which recovers the heat value of the fuels by producing steam. A portion of the exit gases from the gas cleaner 14, at about 250°–350° F., are utilized to provide gas flow 10, reducing the temperature of the fluid bed gases to less than 1,200° F.

The coarse fraction 12 is fed into the boiler 16 onto a grate burner 17. Both over-fire air 18 and undergrate air 19 are provided as necessary.

The fines fuel fraction 13, 15 is conveyed to the boiler 16, combined with air flows 20, 21 and injected through suspension burners 22, 23 into the combustion zone 24.

The hot gases produced in combustion zone 24 from burning by both systems contact steam-producing water tubes 25 or the like. The gas is discharged through gas cleaning means 26 and out the stack 27.

A particulate stream 28 is removed from the boiler stack gases and conveyed to a screen 29. The screen 29 separates combustible fly carbon stream 30 from ash 31. The fly carbon stream 30 may be injected into the fluid bed 7. Fly carbon injection may improve overall heat recovery by roughly 5%.

The fines stream 31 from the fly carbon screen 29 are generally inerts and are combined with the ash 32 removed from grate 17.

The predrying system, in producing heat from drying of wood waste to be fed to the boiler, is capable of combusting other difficult-to-dispose-of waste streams that have heat value and are typically found in integrated pulping-sawmill plants. For example, a dilute, wet sludge from biological treatment of pulping liquors may be disposed of by injecting into the fluid bed 7.

EXAMPLE

The following example describes typical operating conditions for the integrated heat recovery process of this invention.

As designed, the process requires no supplemental oil for normal base load or swing demand operations. The combination of grate and suspension firing of wood waste carries the full boiler steam production design load. Oil is required during this particular system's manual grate cleaning operations. For steaming rates under 132,000 lbs. per hour, the fines burners are operated with oil pilots operating at the equivalent of 16,000 lbs/hr of steam. For steaming rates above 132,000 lbs/hr, oil guns must also carry load. The total annual oil consumption for the system, producing an annual electrical output of 5 megawatts, was reduced to 24,000 barrels per year from 136,000 barrels per year. The remaining oil requirement includes oil necessary during manual grate cleaning, a projected 15% downtime for the wood waste system, and for the fines burner pilots. The process layout for this example is generally depicted in FIG. 1.

A Combustion Power Company fluid bed was selected having a capacity of 5.2 BDT/hour for fuel of 50–68% moisture, 55% less than ⅛" diameter, and a heating value of 8,500–9,000 Btu/bone dry lb.

A Babcock and Wilcox combination wood waste and oil boiler, having:

(a) grate, fixed, water cooled, of 195 $ft^2$ area with two fuel chutes for distributing wood waste thereon, utilizing preheated air of 550°–630° F., and a heat release rate of 25–28 MBtu/$ft^3$-hour; and (b) two each suspension burners capable of burning 2.25 BDT/hour producing 39.6 MMBtu/hour utilizing a fuel less than ⅛" in diameter, 5–15% moisture with a heating value of 8,500–9,000 Btu/bone dry lb.

Tables 1 and 2 outline typical process flows for the operable system.

TABLE 1

| Component | Station Number | Units | Process Flows, Dryer System* Winter Average Steaming Rate 140,000 pph Normal | | Winter Average Grate Cleaning | | Summer Average Steaming Rate 100,000 pph Normal | | Summer Average Grate Cleaning | |
|---|---|---|---|---|---|---|---|---|---|---|
| Reclaim | 1 | BDT/Hr (BDt/Hr) | 14.5 | (13.1) | 21.9 | (19.9) | 8.8 | (8.0) | 13.5 | (12.3) |
| | | % Moisture | 65 | | 65 | | 50 | | 50 | |
| Screen Oversize | 4 | BDT/Hr (BDt/Hr) | 0.1 | (.1) | 0.1 | (0.1) | 0.1 | (0.1) | 0.1 | (0.1) |
| Accepts | 5 | BDT/Hr (BDt/Hr) | 14.4 | (13.1) | 21.8 | (19.8) | 8.7 | (7.9) | 13.4 | (12.2) |
| Fluid Bed Hog Fuel | 4&6 | BDT/Hr (BDt/Hr) | 3.5 | (3.2) | 5.5 | (5.0) | 1.0 | (0.9) | 1.6 | (1.45) |
| | | MMBtu/Hr (GJ/Hr) | 61 | (64) | 96 | (101) | 17 | (18) | 28 | (29) |
| Fly Carbon | 30 | BDT/Hr (BDt/Hr) | 0.3 | (0.3) | 0.3 | (0.3) | 0.1 | (0.1) | 0.1 | (0.1) |
| | | MMBtu/Hr (GJ/Hr) | 11 | (12) | 11 | (12) | 5 | (5) | 5 | (5) |
| Screen Input | 11 | BDT/Hr (BDt/Hr) | 8.0 | (7.3) | 11.9 | (10.8) | 5.7 | (5.2) | 8.6 | (7.9) |
| | | % Moisture | 19 | | 19 | | 19 | | 19 | |
| Accepts | 12 | BDT/Hr (BDt/Hr) | 5.0 | (4.5) | 7.4 | (6.6) | 3.5 | (3.2) | 5.3 | (4.8) |
| | | % Moisture | 30 | | 30 | | 30 | | 30 | |
| Fines | 13 | BDT/Hr (BDt/Hr) | 3.0 | (2.7) | 4.5 | (4.0) | 2.2 | (2.0) | 3.3 | (3.0) |
| | | % Moisture | 10 | | 10 | | 10 | | 10 | |
| Cyclones Fines | 15 | BDT/Hr (BDt/Hr) | 3.0 | (2.7) | 4.5 | (4.1) | 2.1 | (1.9) | 3.3 | (3.0) |
| | | % Moisture | 10 | | 10 | | 10 | | 10 | |

*Numbers in parenthesis are metric

TABLE 2

| Component | Station Number | Units | Process Flows, Boiler System* Winter Average Steaming Rate 140,000 pph Normal | | Winter Average Grate Cleaning | | Summer Average Steaming Rate 100,000 pph Normal | | Summer Average Grate Cleaning | |
|---|---|---|---|---|---|---|---|---|---|---|
| Furnace Wood Waste - Grate Burning | 12 | BDT/Hr (BDt/Hr) | 5.0 | (4.5) | 0 | | 3.5 | (3.2) | 0 | |
| | | % Moisture | 30 | | 0 | | 30 | | 0 | |
| | | MMBtu/Hr (GJ/Hr) | 88 | (92) | 0 | | 62 | (56) | 0 | |
| Suspension | 13&15 | BDT/Hr (BDt/Hr) | 6.0 | (5.4) | 9.0 | (8.2) | 4.3 | (4.0) | 6.6 | (6.0) |
| | | % Moisture | 10 | | 10 | | 10 | | 10 | |
| | | MMBtu/Hr (GJ/Hr) | 106 | (111) | 158 | (166) | 77 | (69.9) | 116 | (105) |
| Oil Suspension Pilot | | Barrels/Hr (L/Hr) | 0 | | 3.24 | (515) | 0 | | 3.24 | (515) |
| | | MMBtu/Hr (GJ/Hr) | 0 | | 19 | (20) | 0 | | 19 | (20) |
| Load | | Barrels/Hr (L/Hr) | 0 | | 1.74 | (277) | 0 | | 0 | |
| | | MMBtu/Hr (GJ/Hr) | 0 | | 10 | (1) | 0 | | 0 | |
| Steam Generation | 25 | Pounds/Hr (kg/Hr) | 140,000 | (63,500) | 140,000 | (63,500) | 100,000 | (45,000) | 100,000 | (45,000) |
| | | Pounds/sq. in (kPa) | 860 | (5,900) | 860 | (5,900) | 860 | (5,900) | 860 | (5,900) |
| | | °F. (°C.) | 800 | (425) | 800 | (425) | 800 | (425) | 800 | (425) |
| Cyclone Fly Carbon | 26 | BDT/Hr (BDt/Hr) | 0.4 | (0.4) | 0.4 | (0.4) | 0.2 | (0.2) | 0.2 | (0.2) |
| | | % Inerts | 30 | | 30 | | 30 | | 30 | |
| | | MMBtu/Hr (GJ/Hr) | 11 | (12) | 11 | (12) | 5 | (5) | 5 | (5) |
| Fly Carbon Screen Overs | 30 | BDT/Hr (BDt/Hr) | 0.3 | (0.3) | 0.3 | (0.3) | 0.1 | (0.1) | 0.1 | (0.1) |
| | | % Inerts | 0 | | 0 | | 0 | | 0 | |
| Fines | 31 | BDT/Hr (BDt/Hr) | 0.1 | (0.1) | 0.1 | (0.1) | 0.1 | (0.1) | 0.1 | (0.1) |
| | | % Inerts | 100 | | 100 | | 100 | | 100 | |

*Numbers in parenthesis are metric

What is claimed is:

1. A method of improving the recovery of heat from wet wood waste, comprising:

predrying the wood waste by the steps of screening the waste into oversize and accepted fractions, feeding said oversize and a portion of the accepted fraction into a fluid bed reactor wherein said feed is about 10–25% by weight of the total wood waste flow, combusting said oversize and a portion of the accepted fraction in the fluid bed reactor, combining the products of combustion from the fluid bed reactor with such air as is necessary to limit exit gas temperatures to less than about 1,200° F., and contacting the balance of the accepted fraction from the initial screening step with the combined hot gas flow wherein said accepted fraction is dried to a moisture content of about 10–30% moisture, by weight; and combusting the dried accepted fraction in a wood waste heat recovery boiler.

2. The process of claim 1, wherein the dried accepted fraction is subjected to the additional steps, comprising:

screening the dried accepts to produce a coarse fuel fraction, having about 30% by weight moisture content, and a fine fuel fraction having 10–15% by weight moisture content; and feeding both fractions into a wood waste heat recovery boiler wherein the coarse fraction is fed onto a grate for supporting said fuel in a combustion zone and the fines fraction are injected, in an air suspension, into said combustion zone.

3. The process of claim 2, wherein the dried coarse fuel fraction is of a size range substantially greater than ⅛" diameter up to 1½" in diameter by 4" long particle size, and the fine fuel fraction is of a size range of less than about ⅛" in diameter particle size.

4. The method of claim 1 wherein the wood waste heat recovery boiler products of combustion are subjected to the additional steps, comprising:

cleaning said gaseous stream to remove particulate matter therefrom;

screening said particulate, resulting in a fly carbon fraction and an inerts ash fraction; and injecting said fly carbon fraction into the fluid bed reactor wherein said carbon combusts, thereby improving overall heat recovery of the hog fuel system and reducing emissions therefrom.

5. The method of claim 1 wherein the accepted fraction and the combined hot gases from the fluid bed reactor are contacted in a rotary dryer.

* * * * *